United States Patent [19]

Cutts

[11] 4,220,005

[45] Sep. 2, 1980

[54] COMBINATION VAPORIZED DRIVING FLUID GENERATOR AND ENGINE UNIT

[76] Inventor: Edmund A. Cutts, Box 8, Oxford, Md. 21654

[21] Appl. No.: 872,037

[22] Filed: Jan. 25, 1978

Related U.S. Application Data

[63] Continuation of Ser. No. 689,045, May 24, 1976, abandoned.

[51] Int. Cl.[2] ..... F01K 11/00

[52] U.S. Cl. ..... 60/514; 60/669; 122/367 C

[58] Field of Search ..... 60/508–515, 60/670, 651, 671, 669; 91/392, 396, 410; 165/4, DIG. 4; 122/40, 367 C, 367 A

[56] References Cited

U.S. PATENT DOCUMENTS

| | | | |
|---|---|---|---|
| 378,663 | 2/1888 | Davidson | 60/669 |
| 1,309,102 | 7/1919 | Rector | 60/514 |
| 3,990,238 | 11/1976 | Bailey | 60/513 |

FOREIGN PATENT DOCUMENTS

| | | | |
|---|---|---|---|
| 825690 | 11/1951 | Fed. Rep. of Germany | 60/514 |

*Primary Examiner*—Allen M. Ostrager
*Assistant Examiner*—Stephen F. Husar
*Attorney, Agent, or Firm*—Schuyler, Birch, McKie & Beckett

[57] ABSTRACT

A vaporized driving fluid generator and engine unit are associated in open communication with each other with driving fluid being injected, in synchronized relation to the cyclic operation of the engine, into an externally heated casing which contains heat conductive elements that displace a substantial portion of the casing volume to vaporize the driving fluid. A cyclically operable expansible chamber engine is used and where such engine includes a reciprocable piston the piston may carry a tapered metering probe which reciprocates in the open communication between the generator and engine to increase the size of the open communication as the engine piston moves away from the open communication toward exhaust porting in the wall of the cylinder containing the piston.

14 Claims, 3 Drawing Figures

COMBINATION VAPORIZED DRIVING FLUID GENERATOR AND ENGINE UNIT

This is a continuation of application Ser. No. 689,045, filed May 24, 1976, now abandoned.

BACKGROUND OF THE INVENTION

This invention relates to a generator for producing vaporized driving fluid and an engine combined with such generator into an unit. More specifically, the invention relates to a vaporized driving fluid generator and engine unit which are in open communication with each other with the vaporized driving fluid being produced from a driving fluid injected into the generator in predetermined quantities and in synchronized relation with the cyclic operation of the engine by the vaporized fluid.

In the art of design and structure of steam plants and engines driven by generated steam, there characteristically have been problems in the high expense of building such equipment, the substantial weight of the components, and difficulty in controlling constantly changing conditions of heat, pressure, water quantity, etc. Seeking to obtain an efficiency in expansible fluid engines to compare with that of the internal combustion engine have only been obtainable where very high temperatures and pressures are employed. This adds the ever present danger of boiler explosion and increases the problems in the areas mentioned above.

For example, in engines where valving is required to control the expansible fluid flow in operation of the engine, such valves must be capable of opening against tremendous pressure loads. Likewise where extreme super heat temperatures are employed the lubricating oil becomes transformed into carbon deposits which cling to the boiler tubes thereby seriously reducing their ability rapidly to transmit heat. Likewise this carbonization of the lubricating oil destroys its ability to lubricate the engine's parts.

THE PRESENT INVENTION

The above-mentioned disadvantages in prior art approaches to generating a vaporized expansible driving fluid with a cyclically operable expansible chamber engine are sought to be overcome by the instant invention. Although water and its generation into steam as the driving fluid is ideally suited for the unit of this invention, fluids other than water such as fluorocarbons, freons, etc. may be employed for the heat carrier.

The generator operates to accumulate heat in material of solid form such as metal rather than storing the heat in a body of liquid. Thus, a substantial portion of the casing in which the driving fluid is vaporized is displaced with metal rather than a liquid such as water constituting the driving fluid. Also, a controlled amount of driving fluid is injected into this casing to be flashed into vaporized driving fluid by the heated solid form metal displacing a large space within the generator casing. By utilizing the substantial accumulated heat within the metal elements taking up a substantial volume of the generator casing, a great supply of heat is available for flashing the injected driving fluid into vapor. Further, the risk of tube burning that can occur when a water storage boiler is allowed to run dry is avoided. Further, if the dry and evacuated generator casing of the instant invention is made of heat resistant material the injected driving fluid is most effectively flashed into vapor.

In the unit of this invention the generator casing is connected in open communication with a cyclically operable expansible chamber engine. This engine may have a cylinder carrying a reciprocable piston with the piston being connected to means such as a piston rod associated with a crank shaft whereby reciprocation of the piston transmits its moving driving force to an energy utilizing mechanism. However, it should be noted that any expansible chamber engine can be used which has a repeating operating cycle. Thus, a rotary wankel engine or reciprocating free piston jack-hammer could be the engine incorporated in the unit with the generator.

The injections of water or other driving fluid are timed or synchronized with the cyclic operation of the engine with the vaporized driving fluid passing through the open communication between the generator casing and engine to drive the engine. Where a piston engine is used, the piston is driven downwardly by the vaporized driving fluid toward exhaust porting in the wall of the cylinder, the piston transmitting its moving force through a piston rod which, as mentioned, may be connected to drive a crank shaft as an energy utilizing mechanism.

Accordingly, it is principal object of this invention to provide a vaporized driving fluid generator containing a substantial portion of heat conductive elements which will accumulate heat from an external heating fluid and flash vaporized water or other driving fluid which is injected in timed relation to the cyclic operation of an expansible chamber engine that is in open communication with the vaporized driving fluid generator.

Another object of the invention is to have the vaporized driving fluid generator and engine in open communication with each other with timed or synchronized injection of a driving fluid, such as water, into the generator for immediate flashing into steam to supply driving force to the engine without need for control valves regulating the flow of vaporized driving fluid. Further, such a generator and engine unit provides excellent dependability.

Another important object of this invention is to provide a generator and vaporized driving fluid engine unit where no body of vaporizable fluid or water carries latent heat which would create an appreciable heat loss when the unit is shut down and no waste of vaporized driving fluid occurs.

Another object of the invention is to provide a vaporized driving fluid generator and engine unit wherein only a simple thermostat is needed for control of the driving fluid generator in shutting off the heat source when the heat accumulating elements of the generator reach this desired operating temperature.

A further object of the invention is providing a vaporized driving fluid generator and engine where no vaporized driving fluid remains in the unit when the engine is stopped and, by driving fluid injection, only the amount of vaporized driving fluid necessary for one cycle of the reciprocating piston engine is present at any one time.

It is a further object of the invention to utilize synchronized pulsating driving fluid injection so that any impurities in the injected driving fluid are vibrated off of the generator casing elements and exhausted.

It is also an object to provide synchronized driving fluid injection timed with engine operating cycles where during low work demands for engine output, one or more driving fluid injections might be omitted while the engine idled under light or no load with injections being resumed when the load increased or the engine requires a driving fluid boost to keep it idling.

This invention is designed to accomplish the above and related end results, and comprises elements and features hereinafter set forth. An illustrative embodiment of the present invention is described below in relation to the accompanying drawings of the same. It is to be understood that this illustrative embodiment suggests only a few of the various cases in which the principals of this invention may be employed.

DESCRIPTION OF AN ILLUSTRATIVE EMBODIMENT

Figure 1:
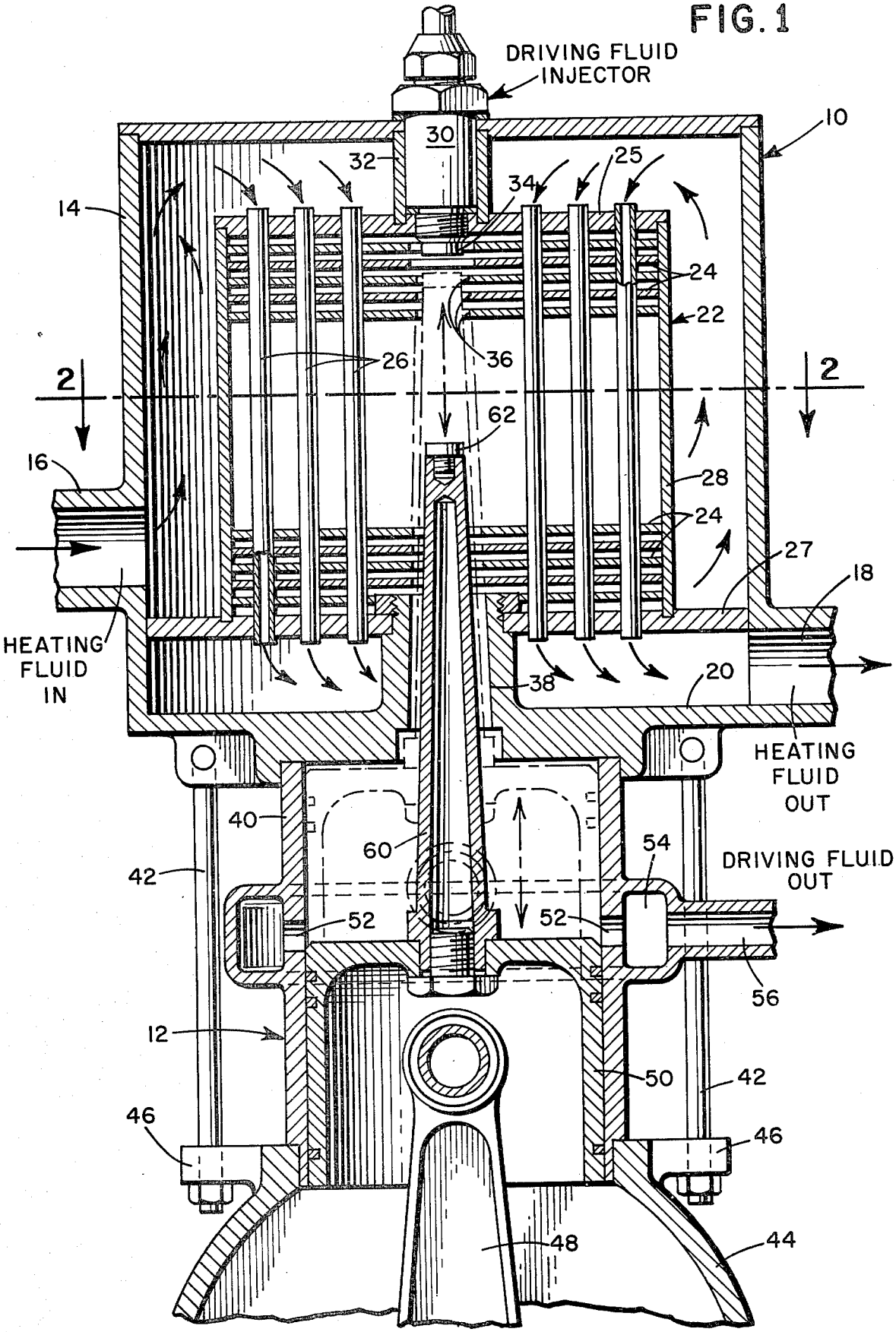
FIG. 1 is a vertical sectional view through the vaporized driving fluid generator and engine unit of this invention.
Figure 2:
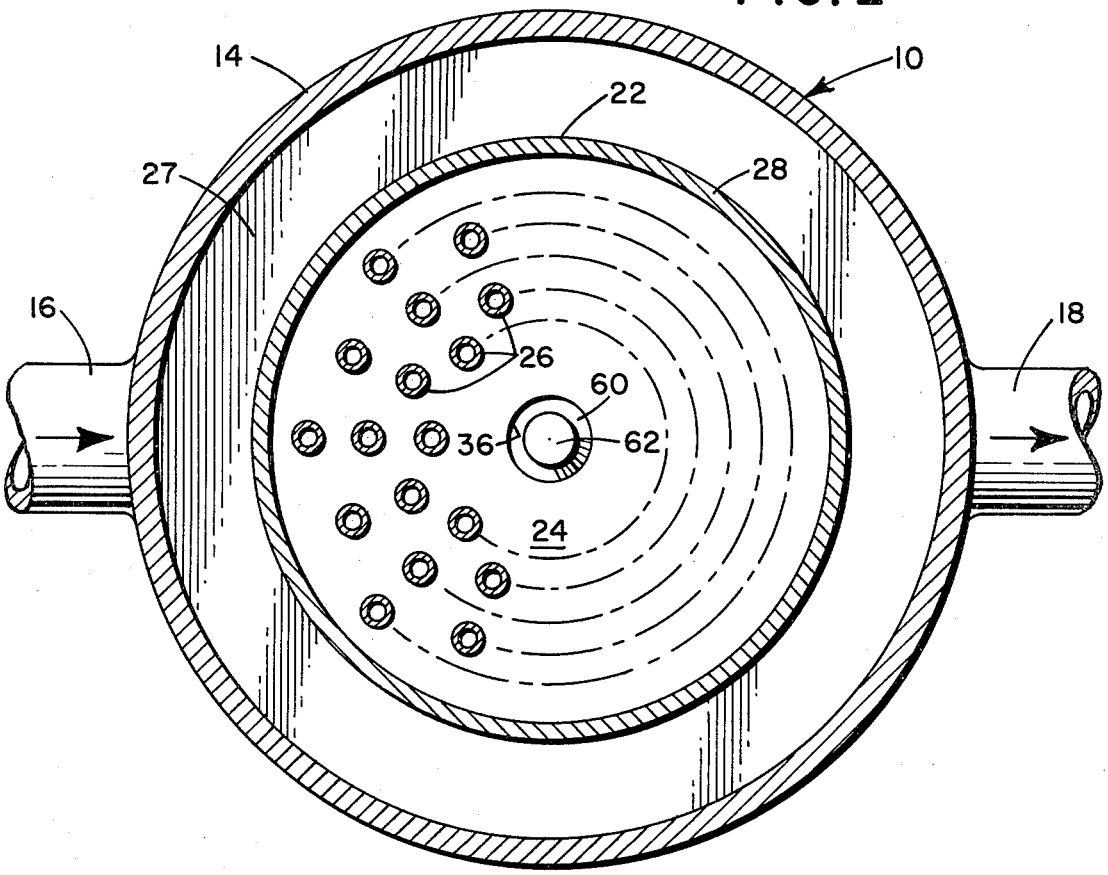
FIG. 2 is a sectional view taken on line 2—2 of FIG. 1.

Referring to FIG. 1, the combination unit is made up of a vaporized driving fluid generator 10 and an engine 12. As will be described in more detail hereinafter, the casing of generator 10 in which the driving fluid is vaporized is connected in open communication with the expansible chamber engine 12 so that the vaporized driving fluid is freely conducted to act in driving the engine. Any cyclically operable expansible chamber engine can be employed.

Considering first the structure of the generator 10, in the illustrated embodiment it is made up with a generator housing 14 having an inlet 16 for heating fluid and an outlet 18 for spent heating fluid. It will be understood that the nature and source of the heating fluid supplied to inlet 16 may take a variety of forms. Inlet 16 may be appropriately connected to a conventional burner system which will supply hot gases to the inlet and thereby to housing 14. The heating fluid may be created from any available combustible material or any other hot gas or hot liquid source suitable for performing the desired driving fluid vaporization in generator 10. Hot air, solar energy, geothermal sources or nuclear energy may provide the heating fluid. The spent heating fluid is led from the generator 10 to a manifold 20 in housing 14 which leads to the heating fluid outlet 18.

Interiorly of generator housing 14, there is provided a casing 22. This casing contains heat conductive elements which may take any desired form to accumulate heat from the heating fluid. In the illustrated embodiment, the elements are made up of a multitude of closely spaced metal plates 24 and a plurality of tubes 26. The tubes extend from the end wall 25 of casing 22 down through the multitude of metal plates and then through the opposite end wall 27 of casing 22 to open into manifold 20. The heating fluid passes around the cylindrical wall 28 of casing 22 up over the top wall 25 and down through the plurality of tubes 26 to exit into manifold 20 and leave by way of outlet 18. The tubes 26 are in heat conducting relationship to the multitude of plates 24 so that these plates are not only heated by way of heat conducted from the cylindrical wall 28 of casing 22 but are also heated along with tubes 26 by the heating fluid passing down through the plurality of tubes 26.

The magnitude of the volume of the interior of casing 22 occupied by the elements, whether they be tubes, plates or some other configuration, is important in the instant invention. These elements occupy a substantial portion of the casing interior volume and provide a heat accumulating body to achieve rapid vaporization of the driving fluid which is injected into the casing as will hereinafter be described.

A driving fluid injector 30 is mounted in the top wall of generator housing 14 in a well formed by a sleeve 32 which disposes the vaporizing injector nozzle in the top wall 25 of casing 22, extending through this wall for the injector nozzle 34 to be exposed on the interior of casing 22.

The multitude of closely spaced plates 24 are centrally provided with apertures 36 with these apertures 36 forming an open column extending through the interior of casing 22 which leads to the hereinabove referred to open communication 38 connecting the interior of casing 22 with the cylinder and piston of engine 12.

Referring now to the expansible chamber engine 12 which communicates with the generator casing 22 by way of open communication 38, the engine is made up of a cylinder 40 suitably secured to the underside of the generator 10 as by means of bolt and nut hangers 42. It will be seen that these hangers extend down and support the engine crank shaft housing 44 by the hangersextending through tabs 46 on the housing 44. This serves to effectively clamp the piston cylinder 40 between the generator 10 and crank shaft housing 44.

It will be understood that housing 44 can suitably contain the piston rod 48 which may conventionally be connected to the crank on a crank shaft mounted in bearings supported by crank shaft housing 44. These latter elements are not shown since they are all conventional in engine construction where a reciprocating piston has its motion translated through a connecting rod and crank shaft to convert the piston's reciprocating movement into rotary motion of the crank shaft. It is to be recognized that the reciprocating motion of the piston may have its moving driving force transmitted through any suitable means to an energy utilizing mechanism within the contemplation of this invention.

A piston 50 is reciprocably mounted in cylinder 40 to be driven by the vaporized driving fluid flowing through open communication 38 from the casing 22 of generator 10. The cylinder 40 has exhaust ports 52 disposed in the cylinder wall remote from the open communication 38 through which the vaporized driving fluid is conducted to act in forcing the piston downwardly to a point where it exposes the ports 52 for exhaust of the spent vaporized driving fluid. The exterior of cylinder 40 is provided with an encircling manifold 54 leading to an exhaust 56 for the spent driving fluid.

Figure 3:
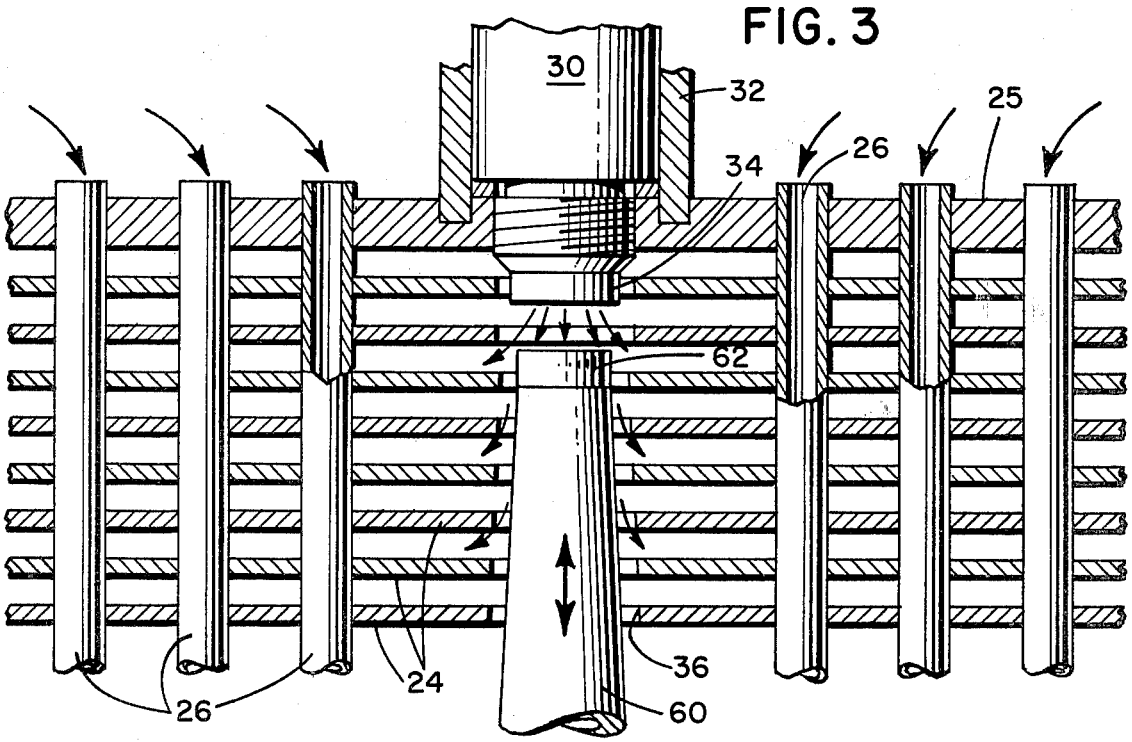
FIG. 3 is an enlarged sectional view of a portion of the vaporized driving fluid generator showing the driving fluid injector and part of the casing containing heat conductive elements.

Note will be taken of piston 50 having a tapered metering probe 60 mounted thereon to extend axially from the head of the piston through the open communication 38 and into the open column extending through the casing 22 of generator 10, the column being formed by the central apertures 36 in the plates 24. This probe 60, by being attached to the piston 50, reciprocates with the piston in and out of the open communication 38. In its uppermost position as shown in FIG. 3, the upper end of the probe which is provided with a wear resistant plug 62 is disposed immediately adjacent the nozzle 34 of injector 30. In this uppermost position, the plug 62 on probe 60 receives the impact of the injected driving fluid from injector 30 and promotes dispersion of the fluid rapidly outwardly into intimate contact with the heated metal plates 24 to promote rapid vaporization or flashing of the fluid into vapor.

It also is to be noted that along with the metering probe being tapered, the open communication 38 between the generator 10 and engine 12 is similarly tapered. Likewise the central apertures 36 in the plates 24 increase in diameter extending downwardly from the injector nozzle 34. When the piston 50 is in its uppermost position in cylinder 40, as shown in phantom lines on FIG. 1, the tapered metering probe is fully inserted into the casing 22 of generator 10. In this position as shown in phantom lines within the casing 22, the annular spaces between probe 60 and the open column formed by the central apertures 36 in the plates and also between probe 60 and the open communication 38 are of a minimum area. At this point, the injector 30 will be operated to inject through atomizing nozzle 34 a predetermined quantity of driving fluid. This driving fluid is dispersed into the heated plates 24 and immediately vaporized thereby. The driving fluid vapor passes down in the annular spaced formed by the probe 60 and plate apertures 36 to act against the piston 50 forcing it downwardly within cylinder 40. As this downward movement progresses the annular space between probe 60 and the apertures 36 in plates 24 as well as the annular flow space between probe 60 and open communication 38 progressively increases permitting the vaporized driving fluid to expand and flow downwardly to continue movement of piston 50. This action proceeds until the piston moves down far enough to expose exhaust ports 52 whereupon the expanded vaporized driving fluid exhausts into manifold 54 and then through exhaust 56. This action exhausts the generator casing 22 of remaining vaporized driving fluid allowing the casing with tubes 26 and plates 24 to reheat under the action of the incoming heating fluid through inlet 16 to ready the generator 10 for the next injection of driving fluid from injector 30.

The operation of engine 12 as by way of momentum of a fly wheel carried on the crank shaft mounted in bearings in crank case 44 thereupon returns the piston 50 to its uppermost position where the next injection of driving fluid is injected through injector 30. The injector 30 is timed or synchronized to eject driving fluid at the proper point in the uppermost movement of piston 50 within cylinder 40 and in a predetermined quantity. This timing may be suitably controlled in relation to the cyclic operating movements of piston 50 to achieve injection of the driving fluid for its vaporization when the piston is again in its uppermost point in readiness to receive the driving force of the vaporized fluid passing down through open communication 38. Appropriate control of this timing or synchronization is not shown. Appropriate conventional control mechanisms may be employed to time the injection in relation to movements of piston 50.

It will be appreciated that the embodiment of this invention herein described is only illustrative. It represents a suggested form of a vaporized driving fluid generator and engine unit for achieving the objects and goals initially set forth. Accordingly, it will be understood that the preferred embodiment set forth is not intended to exclude but rather to suggest such other modifications and adaptations as fall within the spirit and scope of this invention as they are employed within the appended claims.

I claim:

1. A vaporized driving fluid generator and engine unit comprising:

a generator housing for conducting heating fluid past heat conductive elements within the housing, said elements being exposed to said heating fluid within said housing and being carried by a casing to transmit heat from said heating fluid to a driving fluid injected into said casing, said housing surrounding said casing to conduct heating fluid over the exterior of said casing and then through said heat conductive elements, means exposed to ambient air temperature for intermittently injecting successive predetermined quantities of driving fluid into said casing to be vaporized by heat accumulated in said elements, a cyclically operable expansible chamber engine having a reciprocable piston disposed therein and exposed to ambient air temperature in open communication with said casing to receive vaporized driving fluid from said casing and by expansion of said driving fluid within said engine produce operation of said engine means extending directly from said piston and movable thereby to restrict flow through the said open communication, and means controlling said driving fluid injecting means to inject said driving fluid quantities synchronized with the cyclic operation of said expansible chamber engine.

2. A unit as recited in claim 1 wherein said expansible chamber engine comprises a cylinder having driving fluid exhaust port means remote from said open communication and a piston reciprocably mounted in said cylinder to be driven by the vaporized driving fluid away from the open communication end of said cylinder to open said exhaust port means.

3. A vaporized driving fluid generator and engine unit comprising:

a generator housing for conducting heating fluid past heat conductive elements within the housing, said elements being exposed to said heating fluid within said housing and being carried by a casing to transmit heat from said heating fluid to a driving fluid injected into said casing, means exposed to ambient air temperature for intermittently injecting successive predetermined quantities of driving fluid into said casing to be vaporized by heat accumulated in said elements, a cylinder having a reciprocable piston disposed therein and exposed to ambient air temperature in open communication with said casing and having driving fluid exhaust port means remote from the open communication between said casing and said cylinder, said open communication being opposite said injecting means, a piston reciprocably mounted in said cylinder to be driven by the vaporized driving fluid away from the open communication end of said cylinder to open said exhaust port means, means extending directly from said piston and movable thereby to vary the size of said open communication, means connecting said piston to transmit its moving driving force to an energy utilizing mechanism, and means controlling said driving fluid injecting means to inject said driving fluid quantities synchronized with reciprocating movement of said piston.

4. A unit as recited in claim 3 wherein said open communication between said casing and said cylinder extends in the direction of reciprocating movement of said piston, and said piston carries a tapered metering probe which extends through said open communication and is withdrawn from said communication as said piston moves toward said exhaust port means to increase the flow area of said open communication.

5. A unit as recited in claim 4 wherein said driving fluid injecting means injects against the end of said metering probe and said metering probe is provided with a wear resistant plug on the end against which driving fluid is injected.

6. A unit as recited in claim 3 wherein said casing encloses a multitude of closely spaced metal plate elements and a plurality of tube elements making up said heat conducting elements, said tube elements passing through said plate elements and opening through end walls of said casing into said generator housing to receive heating fluid and conduct it through said casing to heat said tube elements and said plate elements, said plate elements displacing a substantial portion of the volume within said casing to provide a heat accumulating body for rapid vaporization of the injected driving fluid.

7. A unit as recited in claim 6 wherein said plate elements are each centrally apertured to form an open column extending through the interior of said casing which leads to said open communication between said casing and said cylinder.

8. A unit as recited in claim 7 wherein said driving fluid injecting means is mounted to inject driving fluid along said open column toward said open communication.

9. A unit as recited in claim 7 wherein said piston carries a tapered metering probe which extends through said open communication and through said open column to disperse driving fluid vaporized within said casing.

10. A unit as recited in claim 3 wherein said casing encloses a multitude of closely spaced metal elements making up said heat conducting elements, said elements displacing a substantial portion of the volume within said casing to provide a heat accumulating body for rapid vaporization of the injected driving fluid.

11. A unit as recited in claim 10 wherein said metal elements are metal plates.

12. A unit as recited in claim 10 wherein said piston carries a tapered metering probe which extends through said open communication and is withdrawn from said communication as said piston moves toward said exhaust port means to increase the flow area of said open communication.

13. A unit as recited in claim 12 wherein said tapered metering probe carries a wear resistant plug affixed to its outer most end and said driving fluid injecting means is mounted to inject driving fluid against said wear resistant plug.

14. A unit as recited in claim 3, wherein said open communication between said casing and said cylinder is tapered and a tapered metering probe corresponding to the taper of said open communication is carried by said piston.

* * * * *